United States Patent [19]

Knecht et al.

[11] Patent Number: 4,778,010

[45] Date of Patent: Oct. 18, 1988

[54] PROCESS FOR INJECTION OF OXIDANT AND LIQUID INTO A WELL

[75] Inventors: Peter Knecht; Thomas R. Schulte, both of Tonawanda; Raymond F. Drnevich, Clarence Center, all of N.Y.

[73] Assignee: Union Carbide Corporation, Danbury, Conn.

[21] Appl. No.: 27,543

[22] Filed: Mar. 18, 1987

[51] Int. Cl.[4] ..... E21B 43/243; E21B 43/16

[52] U.S. Cl. ..... 166/261; 166/269; 166/305.1; 166/313

[58] Field of Search ..... 166/260, 261, 268, 269, 166/305.1, 309, 313; 299/6

[56] References Cited

U.S. PATENT DOCUMENTS

| | | | |
|---|---|---|---|
| 1,658,305 | 2/1928 | Russell | 166/269 X |
| 2,973,812 | 3/1961 | MacSporran | 166/26 X |
| 2,994,375 | 8/1961 | Hurley . | |
| 3,019,838 | 2/1962 | Harlan et al. | 166/261 X |
| 3,127,935 | 4/1964 | Poettmann et al. | 166/260 |
| 3,159,215 | 12/1964 | Meldau et al. . | |
| 3,196,945 | 7/1965 | Craig et al. . | |
| 3,208,519 | 9/1965 | Moore . | |
| 3,344,856 | 10/1967 | Lange | 166/261 X |
| 3,371,711 | 3/1968 | Odeh et al. | 166/268 |
| 3,448,807 | 6/1969 | Strickland, Jr. | 166/309 X |
| 3,504,745 | 4/1970 | Elkins | 166/261 |
| 3,630,573 | 12/1971 | Goddin, Jr. et al. | 166/269 X |
| 4,072,191 | 2/1981 | Clampit | 166/261 |
| 4,234,042 | 11/1980 | Kirkpatrick et al. | 166/261 |
| 4,252,191 | 2/1981 | Pusch et al. | 166/261 |
| 4,418,751 | 12/1983 | Emery | 166/261 |
| 4,440,227 | 4/1984 | Holmes | 166/261 |
| 4,450,910 | 5/1984 | Hunt, III | 166/261 |
| 4,493,369 | 1/1985 | Odeh et al. | 166/261 |
| 4,509,595 | 4/1985 | Savard et al. | 166/261 |
| 4,637,460 | 1/1987 | McGlothen et al. | 166/313 X |

*Primary Examiner*—George A. Suchfield
*Attorney, Agent, or Firm*—Stanley Ktorides

[57] ABSTRACT

A process and apparatus for fireflooding with liquid heat transfer media comprising injection of oxidant gas and liquid heat transfer media into a well through separate conduits, the liquid conduit downstream end submerged in a liquid volume, so as to form a seal and prevent oxidant gas migration into the liquid conduit.

25 Claims, 1 Drawing Sheet

PROCESS FOR INJECTION OF OXIDANT AND LIQUID INTO A WELL

TECHNICAL FIELD

This invention relates to fireflooding wherein liquid, e.g., water, is injected into a well along with oxidant to improve the thermal efficiency of the in-situ combustion.

BACKGROUND ART

Fireflooding is a process for the enhanced recovery of oil from a petroleum reservoir. In a fireflood operation a gaseous oxidant such as air, oxygen enriched air, or high purity oxygen, is injected into a well that extends into a reservoir. The oxidant reacts in-situ with some of the fuel in the reservoir. This combustion releases heat and produces carbon dioxide as one combustion reaction product. The viscosity of the heavy oil within the reservoir is reduced by the released heat and by dissolution of combustion gases. The pressure and heat front associated with the fireflood operation serve to improve movement of the oil toward production wells and result in increased recovery of the oil.

The selection of air or oxygen for fireflood operations generally depends on the reservoir characteristics. For many applications high purity oxygen is more economical than air because approximately only one fifth the flow rate is required to inject equivalent oxygen thereby reducing compression energy for injection into the reservoir. Also, by using high purity oxygen, the injection of large amounts of nitrogen into the reservoir is avoided thus serving to improve the quality of gaseous fuels or carbon dioxide which may be recovered from the reservoir and reducing the required gas treatment capacity and associated costs.

With oxidant injection by itself, only about one third of the in-situ generated heat serves to improve heavy oil mobility within the reservoir while about two thirds of the in situ generated heat remains in the burned out portion of the reservoir. This problem has been addressed by injecting a liquid heat transfer medium, e.g. water, into the reservoir along with the oxidant in either an intermittent or continuous manner. The resultant steam adds to the combustion front gas flow and transfers heat to the oil upon its condensation. This serves to carry heat away from the combustion zone of the reservoir and causes improved mobility of the heavy oil with increased thermal efficiency for the fireflood operation.

One problem with this use of water is the possibility of some of the oxidant passing into the water delivery system. The presence of the oxidant within the water delivery system substantially increases the probability of corrosion and thus failure of the equipment. Further, the water injection piping and valves may contain hydrocarbon contaminants. Thus oxidant contact with the water injection string is quite hazardous because of the marked increase in thepossibility of fire or explosion. Each of these problems is heightened when high purity oxygen is employed as the oxidant.

It is therefore an object of this invention to provide a process and apparatus for the injection of gaseous oxidant and liquid heat transfer media into a well while preventing oxidant migration into the liquid delivery system.

SUMMARY OF THE INVENTION

The above and other objects which will become apparent to one skilled in the art upon a reading of this disclosure are attained by the present invention one aspect of which is:

A process for the injection of gaseous oxidant and liquid heat transfer media into a well comprising injecting gaseous oxidant into the well through a first conduit, injecting liquid heat transfer media into the well through a second conduit, and maintaining the downstream end of the second conduit submerged in liquid.

Another aspect of the present invention is:

Apparatus for the injection of gaseous oxidant and liquid heat transfer media into a well comprising a first conduit extending into the well for the injection of oxidant, a second conduit extending into the well for the injection of liquid heat transfer media, a volume of liquid within the well, the downstream end of the second conduit submerged within said volume of liquid.

DETAILED DESCRIPTION

The invention will be described in detail with reference to the drawings.

Figure 1:
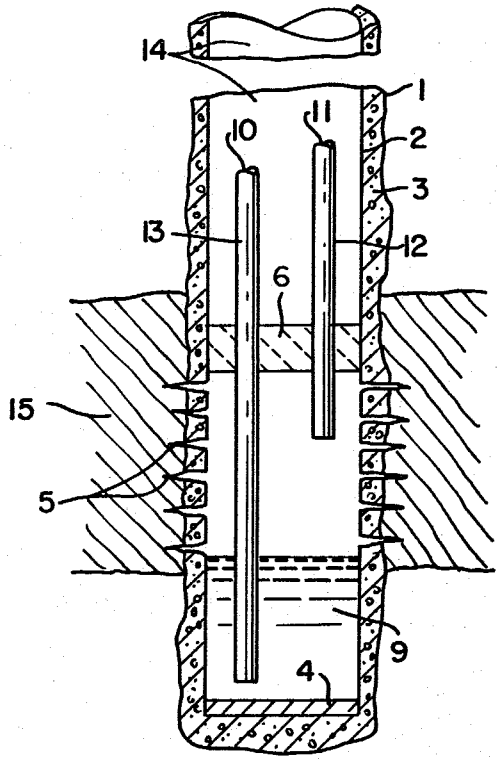
FIG. 1 is a cross sectional representation of one embodiment of the invention wherein only the second conduit downstream end is submerged and the second conduit discharges below the point the first conduit discharges.

Referring now to FIG. 1, injection wellbore 1 is drilled down through the earth and rock into fuel formation 15. Injection wellbore 1 is circular in cross-section having a diameter generally within the range of from 4 to 14 inches. Injection wellbore 1 has a casing 2 which forms the well perimeter from the ground level to the well bottom plug 4. The casing 2 is surrounded by and may be supported by cement 3. Along at least some of the well depth which passes through formation 15 the casing 2 has a plurality of perforations 5. Perforations 5 pass through casing 2 and cement 3 and communicate with formation 15. At least some of the length of casing 2, generally from 10 to 40 feet, extends below the perforated portion.

Within the well interior above the plurality of perforations is packer 6. Packer 6 serves to ensure that the injected matter remains in the well and does not flow up through the annular space between the well tubing and casing. The well interior 14 above the packer 6 is either blown dry and charged with an inert gas such as nitrogen or carbon dioxide, or is filled with corrosion inhibited water.

First conduit 12 extends into the well past packing 6 and has its downstream end within or above the well volume defined by the perforated casing. Oxidant 11, which may be air, oxygen enriched air, or high purity oxygen, is passed through first conduit 12 and injected into the well through the downstream end of conduit 12. The oxidant is injected into the well at a rate within the range of from 1 to 200 tons per day and preferably within the range of from 5 to 50 tons per day. The oxidant passes through perforations 5 and into formation 15 wherein it reacts in situ with the fuel. As used herein the term high purity oxygen means oxygen having a purity of at least 99 percent.

Second conduit 13 extends into the well past packer 6 and has its downstream end within the well volume defined by the unperforated casing below the perforations 5. Liquid heat transfer media 10, which is generally water, is passed through second conduit 13 and injected into the well through the downstream end of conduit 13. The liquid is injected into the well at a rate generally within the range of from ¼ to 2 barrels per minute (10 to 80 gallons per minute).

The downstream end of conduit 13 is submerged in liquid volume 9 within the well volume defined by the unperforated casing below the perforations 5. Liquid 10 serves to replenish liquid volume 9 either continuously or intermittently. As the liquid volume 9 rises up to perforations 5, liquid 10 passes through perforations 5 and into formation 15 wherein it is heated and preferably vaporized by heat from the aforesaid combustion of oxidant and fuel. This serves to facilitate the transfer of heat from the area proximate injection wellbore 1 to portions of formation 15 distant from injection wellbore 1.

The downstream end of second conduit 13 is maintained submerged within liquid volume 9. In this way liquid volume 9 forms a liquid seal around the downstream end of second conduit 13 and thus prevents oxidant 11 from passing up through second conduit 13. This results in a number of advantages. Safety is improved by the prevention of the migration of oxidant such as high purity oxygen or air into upstream systems which are neither designed, nor cleaned, to handle these oxidants. Furthermore the incidence of upstream corrosion is reduced resulting in a further improvement in safety as well as in a reduction in piping or injection string costs. For example, althouqh the use of corrosion and ignition resistant materials, such as nickel based alloys, is preferred for piping below packer 6, with the use of the invention one may use much les expensive carbon steel for the piping above packer 6. Costs are further reduced by prevention of oxidant backflow up the liquid conduit without the need for check valves or other complicated or difficult to maintain equipment.

An added benefit of the invention is a reduction in the hydrocarbon accumulation at the bottom of the well. Such hydrocarbon accumulation is potentially hazardous and is caused by seepage from formation 15 through perforations 5 and down into the well. This benefit is accomplished by the submerged injection of liquid 10 into liquid volume 9 causing agitation of the entire volume 9 resulting in the flotation of hydrocarbons which are then carried out of the well by rising liquid volume 9. Since hydrocarbons do not accumulate in the bottom of wellbore 1, this area need not be plugged back upon the completion of the work resulting in a further cost reduction.

Figure 2:
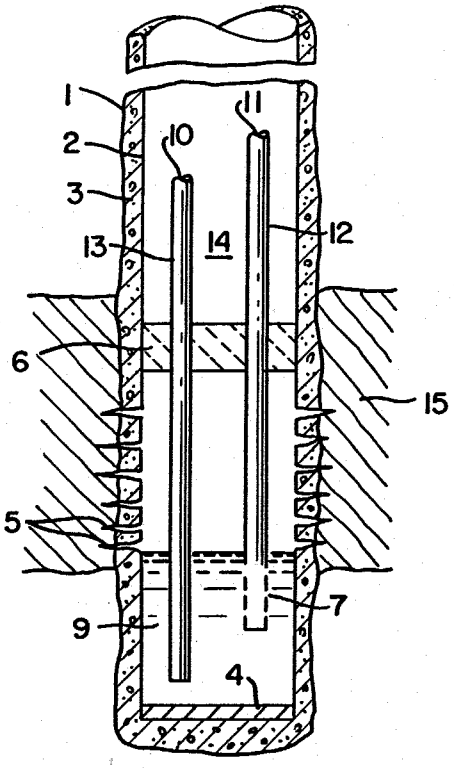
FIG. 2 is a cross-sectional representation of another embodiment of the invention wherein both the first and second conduits have their downstream ends submerged.

Another embodiment of the invention is illustrated in FIG. 2. The numerals of FIG. 2 are identical to those of FIG. 1 for the common elements. In the embodiment illustrated in FIG. 2, first conduit 12 extends further than the volume defined by the perforated casing and extends into the well volume defined by the unperforated casing below perforations 5. In this embodiment the downstream end of conduit 12 is also submerged in liquid volume 9. Preferably, as shown in FIG. 2, the lowermost portion of first conduit 12 has perforations 7 or other modifications for foaming such as spargers or nozzles. When employing the embodiment of FIG. 2, it is important that the downstream end of second conduit 13 be oriented below the downstream end of first conduit 12. Preferably liquid 10 additionally contains one or more foaming agents, such as alkaryl or alpha olefin sulfonates, to increase the volumetric sweep efficiency of the liquid. The embodiment of FIG. 2 is advantageous in that foam is generated by the bubbling action of the submerged oxidant injection. In this embodiment the oxidant bubbles up through liquid volume 9 into the volume defined by the perforated casing and from there through perforations 5, and into formation 15.

Figure 3:
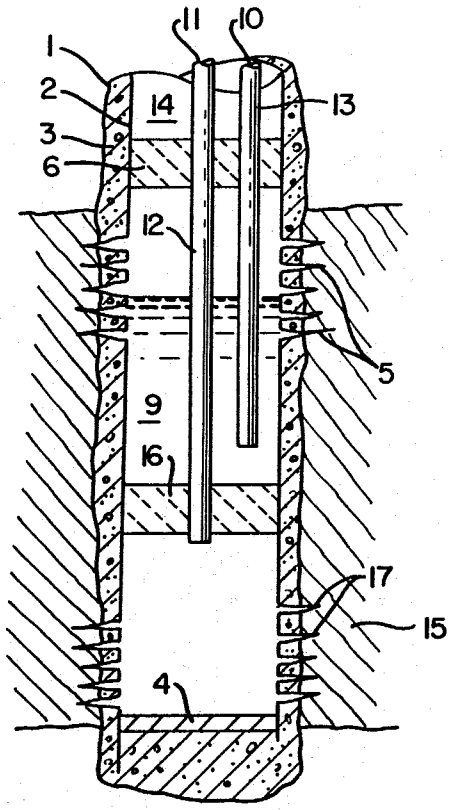
FIG. 3 is a cross-sectional representation of another embodiment of the invention wherein the second conduit discharges above the point where the first conduit discharges.

FIG. 3 illustrates another embodiment of this invention which is particularly applicable in the fireflooding of thick formations. The numerals of FIG. 3 correspond to those of FIG. 1 for the common elements. In this embodiment there is a second packer 16 below the well volume defined by the unperforated casing below the perforations 5, and the liquid volume 9 rests on this packer 16 rather than on well bottom 4. Second conduit 12 extends through packer 16 and serves to inject oxidant into the well volume below packer 16. Oxidant passes out through second plurality of perforations 17 and into formation 15 for in-situ combustion of fuel. This stratified injection arrangement serves to reduce fluid gravity effects, such as override of gas, and to increase sweep efficiency in such thick formations. The liquid seal at the downstream end of second conduit 13 prevents gases which might migrate through perforations 5 from entering second conduit 13.

Generally, it is expected that the liquid seal for the second conduit carrying the water should be in the range of from 5 to 30 feet of liquid. Thus for the embodiments illustrated in FIGS. 1 and 3 the second conduit should be submerged about 5 to 30 feet, whereas for the embodiment illustrated in FIG. 2 the difference between the ends of the two submerged conduits should be about 5 to 30 feet.

Now by the use of the present invention one may employ fireflooding with oxidant, especially high purity oxygen, and liquid heat transfer media with markedly reduced injection string costs and with increased safety while operating the fireflooding operation with increased efficiency. While the process and apparatus of this invention have been described in detail with reference to certain specific embodiments, it is understood that there are other embodiments of the invention within the spirit and scope of the claims. For example, although the oxidant and liquid heat transfer media must be injected into the well throuqh separate conduits, the conduits need not be spaced from each other as illustrated in the Figures, but rather, the conduits could be coaxial. Also, the well and consequently the conduits need not be vertically oriented but may oriented at an angle of up to about 60 degrees.

We claim:

1. A fireflooding process comprising injection gaseous oxidant into a well extending into a fuel formation through a first conduit, injecting liquid heat transfer media into the well through a second conduit, maintaining the downstream end of the first conduit above the downstream end of the second conduit, maintaining the downstream end of the second conduit submerged in liquid heat transfer media, and passing oxidant and liquid heat transfer media from the well into the fuel formation.

2. The process of claim 1 wherein the gaseous oxidant and liquid heat transfer media pass out of the well through a plurality of perforations in the side of the well.

3. The process of claim 1 wherein the gaseous oxidant is air.

4. The process of claim 1 wherein the gaseous oxidant is oxygen enriched air.

5. The process of claim 1 wherein the gaseous oxidant is high purity oxygen.

6. The process of claim 1 wherein the liquid heat transfer media is water.

7. The process of claim 1 wherein the liquid heat transfer media additionally contains at least one foaming agent.

8. The process of claim 1 wherein the downstream end of the second conduit is submerged from 5 to 30 feet.

9. The process of claim 1 wherein the downstream end of the first conduit is also maintained submerged in the liquid and is oriented above the downstream end of the second conduit.

10. The process of claim 9 wherein the vertical distance between the submerged ends of the first and second conduits is within the range of from 5 to 30 feet.

11. The process of claim 1 further comprising reducing hydrocarbon accumulation within the liquid by agitating the liquid with the submerged injection of liquid heat transfer media to cause flotation of hydrocarbons within the liquid.

12. The process of claim 1 wherein the liquid is continuously replenished by the submerged injection of liquid heat transfer media.

13. The process of claim 1 wherein the liquid is intermittently replenished by the submerged injection of liquid heat transfer media.

14. The process of claim 9 wherein foam is generated by the submerged injection of oxidant into the liquid.

15. A process for the injection of gaseous oxidant and liquid heat transfer media into a well comprising injecting gaseous oxidant into the well through a first conduit, injecting liquid heat transfer media into the well through a second conduit, maintaining the downstream end of the second conduit submerged in liquid, maintaining the downstream end of the first conduit submerged in liquid and above the downdstream end of the second conduit, and generating foam by the submerged injection of oxidant into the liquid.

16. The process of claim 15 wherein the gaseous oxidant and liquid heat transfer media pass out of the well through a plurality of perforations in the side of the well.

17. The process of claim 15 wherein the gaseous oxidant is air.

18. The process of claim 15 wherein the gaseous oxidant is oxygen-enriched air.

19. The process of claim 15 wherein the gaseous oxidant is high purity oxygen.

20. The process of claim 15 wherein the liquid heat transfer media is water.

21. The process of claim 15 wherein the liquid heat transfer media additionally contains at least one foaming agent.

22. The process of claim 15 wherein the vertical distance between the submerged ends of the first and second conduits is within the range of from 5 to 30 feet.

23. The process of claim 15 further comprising reducing hydrocarbon accumulation within the liquid by agitating the liquid with the submerged injection of liquid heat transfer media to cause flotation of hydrocarbons within the liquid.

24. The process of claim 15 wherein the liquid is continuously replenished by the submerged injection of liquid heat transfer media.

25. The process of claim 15 wherein the liquid is intermittently replenished by the submerged injection of liquid heat transfer media.

* * * * *

UNITED STATES PATENT AND TRADEMARK OFFICE

CERTIFICATE OF CORRECTION

PATENT NO. : 4,778,010

DATED : October 18, 1988

INVENTOR(S) : Peter Knecht et al

It is certified that error appears in the above-identified patent and that said Letters Patent is hereby corrected as shown below:

In column 3, line 43 delete "les" and insert therefor --less--.

In claim 1, line 1 delete "injection" and insert therefor --injecting--.

In claim 15, line 8, delete "doundstream" and insert therefor --downstream--.

Signed and Sealed this

Seventh Day of March, 1989

*Attest:*

DONALD J. QUIGG

*Attesting Officer*

*Commissioner of Patents and Trademarks*